US011749240B2

(12) United States Patent
Kusakabe

(10) Patent No.: US 11,749,240 B2
(45) Date of Patent: Sep. 5, 2023

(54) BEAT TIMING GENERATION DEVICE AND METHOD THEREOF

(71) Applicant: Roland Corporation, Shizuoka (JP)

(72) Inventor: Satoshi Kusakabe, Shizuoka (JP)

(73) Assignee: Roland Corporation, Shizuoka (JP)

( * ) Notice: Subject to any disclaimer, the term of this patent is extended or adjusted under 35 U.S.C. 154(b) by 423 days.

(21) Appl. No.: 17/057,696

(22) PCT Filed: May 24, 2018

(86) PCT No.: PCT/JP2018/020079
§ 371 (c)(1),
(2) Date: Nov. 23, 2020

(87) PCT Pub. No.: WO2019/224990
PCT Pub. Date: Nov. 28, 2019

(65) Prior Publication Data
US 2021/0241729 A1 Aug. 5, 2021

(51) Int. Cl.
*G10H 1/00* (2006.01)

(52) U.S. Cl.
CPC ..... *G10H 1/0008* (2013.01); *G10H 2210/076* (2013.01); *G10H 2210/391* (2013.01)

(58) Field of Classification Search
CPC ..... G10H 1/0008; G10H 2210/076; G10H 2210/391
USPC ..... 84/623
See application file for complete search history.

(56) References Cited

U.S. PATENT DOCUMENTS 7,373,209 B2 * 5/2008 Tagawa ..... G06F 16/40 381/98
7,534,951 B2 * 5/2009 Yamashita ..... G10H 1/368 84/611
7,923,621 B2 * 4/2011 Shiraishi ..... G10H 1/40 84/612
8,269,093 B2 * 9/2012 Naik ..... G10H 1/40 84/612
8,426,715 B2 * 4/2013 Bregar ..... G11B 20/10527 84/611
8,436,241 B2 * 5/2013 Yamashita ..... G10H 1/40 84/611

(Continued)

FOREIGN PATENT DOCUMENTS

CN 104620313 A * 5/2015 ..... G10H 1/40
JP 2002150689 5/2002

(Continued)

OTHER PUBLICATIONS

"Office Action of Japan Counterpart Application", dated Nov. 24, 2021, with English translation thereof, pp. 1-6.

(Continued)

*Primary Examiner* — Christina M Schreiber
(74) *Attorney, Agent, or Firm* — JCIPRNET

(57) ABSTRACT

A beat timing generation device including a generation unit for generating, from data of music that has been input, information of timings on which a beat of the music depends and a plurality of pieces of intensity data indicating a power at the timings; a calculation unit for calculating a period and a phase of the beat of the music using the plurality of pieces of intensity data; and a detection unit for detecting a beat generation timing on a basis of the period and the phase of the beat.

20 Claims, 9 Drawing Sheets

(56) References Cited

U.S. PATENT DOCUMENTS

| | | | | |
|---|---|---|---|---|
| 8,704,069 | B2 * | 4/2014 | Naik | G10H 1/40 84/612 |
| 10,262,640 | B2 * | 4/2019 | Takehisa | G10H 1/42 |
| 2005/0117032 | A1 * | 6/2005 | Ueda | H04N 5/9201 |
| 2006/0127054 | A1 * | 6/2006 | Matsuyama | H04N 1/00933 386/231 |
| 2007/0234882 | A1 * | 10/2007 | Usa | G10H 1/0008 84/612 |
| 2008/0276793 | A1 * | 11/2008 | Yamashita | G10H 1/40 84/611 |
| 2009/0056526 | A1 * | 3/2009 | Yamashita | G10L 25/48 84/611 |
| 2009/0287323 | A1 * | 11/2009 | Kobayashi | G10H 1/0008 84/453 |
| 2010/0282045 | A1 * | 11/2010 | Chen | G10H 1/40 84/612 |
| 2011/0144780 | A1 * | 6/2011 | Ueshima | G10H 1/368 700/94 |
| 2013/0226957 | A1 * | 8/2013 | Ellis | G06F 16/634 707/769 |
| 2015/0094835 | A1 * | 4/2015 | Eronen | G10H 1/0008 700/94 |
| 2020/0152162 | A1 * | 5/2020 | Maezawa | G10H 1/0008 |
| 2020/0357368 | A1 * | 11/2020 | Yoshino | G10L 25/51 |
| 2021/0241729 | A1 * | 8/2021 | Kusakabe | G10H 1/40 |
| 2022/0020348 | A1 * | 1/2022 | Kusakabe | G10H 1/368 |
| 2022/0351707 | A1 * | 11/2022 | Kusakabe | G10G 3/04 |
| 2023/0053899 | A1 * | 2/2023 | Minakata | G10H 1/38 |

FOREIGN PATENT DOCUMENTS

| | | | | |
|---|---|---|---|---|
| JP | 2003289494 | | 10/2003 | |
| JP | 2004302053 | | 10/2004 | |
| JP | 2006102080 | | 4/2006 | |
| JP | 2006153923 | | 6/2006 | |
| JP | 2007033851 | | 2/2007 | |
| JP | 2008107569 | | 5/2008 | |
| JP | 2008275975 | | 11/2008 | |
| JP | 2008283305 | | 11/2008 | |
| JP | 2009092681 | | 4/2009 | |
| JP | 2009098262 | | 5/2009 | |
| JP | 2010055076 | | 3/2010 | |
| JP | 4561735 | | 10/2010 | |
| JP | 2011164497 | | 8/2011 | |
| JP | 2012118417 | | 6/2012 | |
| JP | 2017219595 | | 12/2017 | |
| JP | 2018180480 | | 11/2018 | |
| JP | 2020529235 | A * | 10/2020 | |
| WO | 2008129837 | | 10/2008 | |
| WO | WO-2019043798 | A1 * | 3/2019 | G10G 3/04 |

OTHER PUBLICATIONS

"Written Opinion and Written amendment of Japan Counterpart Application", submitted on Jan. 20, 2022, with English translation thereof, pp. 1-8.

"International Search Report (Form PCT/ISA/210) of PCT/JP2018/020079," dated Aug. 7, 2018, with English translation thereof, pp. 1-5.

* cited by examiner

BEAT TIMING GENERATION DEVICE AND METHOD THEREOF

CROSS-REFERENCE TO RELATED APPLICATION

This application is a 371 application of the International PCT application serial no. PCT/JP2018/020079, filed on May 24, 2018. The entirety of the above-mentioned patent application is hereby incorporated by reference herein and made a part of this specification.

BACKGROUND

Technical Field

The present disclosure relates to a beat timing generation device and a beat timing generation method.

Background Art

In the related art, there are devices outputting tempo information reflecting a playing tempo (for example, Patent Literature 1). In addition, there is a technology in which a tempo clock synchronized with music included in an audio signal can be generated (for example, refer to Patent Literature 2 and Patent Literature 3). In addition, there is a technology in which a rhythm pattern of an input acoustic signal is determined (for example, Patent Literature 4).

CITATION LIST

Patent Literature

[Patent Literature 1]
Japanese Patent Laid-Open No. 2010-055076
[Patent Literature 2]
Japanese Patent Laid-Open No. 2009-092681
[Patent Literature 3]
Japanese Patent Laid-Open No. 2009-098262
[Patent Literature 4]
Japanese Patent Laid-Open No. 2008-275975

SUMMARY

Technical Problem

On an occasion of performing or singing music, listeners often add hand clapping to the music in accordance with the rhythm thereof. It is conceivable that such hand clapping be added automatically (without depending on manual operation) during a performance or a reproduction of music. Incidentally, technologies in the related art are used when generating tempo information or a tempo clock or determining a rhythm pattern, and automatic output of hand clapping is not taken into consideration, whereby a large amount of complicated calculation is required.

The present disclosure has been made in consideration of the foregoing circumstances, and an objective thereof is to provide a beat timing generation device and a beat timing generation method capable of generating timings of a beat with a small amount of calculation.

Solution to Problem

According to an aspect of the present disclosure, there is provided a beat timing generation device including a generation unit for generating, from data of music that has been input, information of timings on which a beat of the music depends and a plurality of pieces of intensity data indicating a power at the timings, a calculation unit for calculating a period and a phase of the beat of the music using the plurality of pieces of intensity data, and a detection unit for detecting a beat generation timing on a basis of the period and the phase of the beat.

The beat timing generation device may further include a reproduction processing unit for performing reproduction processing of the beat in accordance with the beat generation timing.

The beat timing generation device may employ a configuration in which the calculation unit sets a beats per minute (BPM) for the plurality of pieces of intensity data on a basis of the timings indicated by the plurality of pieces of intensity data, calculates one period of the BPM as the period of the beat, and calculates a relative position of the beat generation timing in a sine wave indicating the BPM as the phase of the beat; and the detection unit obtains a count value indicating the period of the beat and the phase of the beat, performs counting up to the count value using a counter incremented for a sampling rate for each one of samples, and detects a timing as the beat generation timing when a value of the counter reaches the count value.

The beat timing generation device may employ a configuration in which the calculation unit calculates, as the period of the beat, one period of the BPM at a time when a value of Fourier conversion data obtained through Fourier conversion performed for each of the plurality of pieces of intensity data and each of a plurality of BPM becomes the largest.

The beat timing generation device may employ a configuration in which when the Fourier conversion data is obtained for each of the plurality of pieces of intensity data and a first BPM of the plurality of BPM, the calculation unit acquires the Fourier conversion data for at least one second BPM having a vibrational frequency which is an integral multiple of a vibrational frequency of the first BPM, and the calculation unit sums up a value of the Fourier conversion data calculated using the first BPM and a value of the Fourier conversion data calculated using the second BPM at a predetermined proportion as a value of the Fourier conversion data for the first BPM.

The beat timing generation device may employ a configuration in which the generation unit acquires a frame consisting of a predetermined number of continuous samples of sound from data of the music that has been input, performs thinning of the samples in the frame, performs fast Fourier conversion for the thinned samples, performs processing of obtaining data indicating a sum of powers of each frequency bandwidth obtained through fast Fourier conversion at predetermined intervals, and extracts data indicating the sum of the powers as the intensity data when the data indicating the sum of the powers indicating a value larger than itself has not been in existence continues for a predetermined time.

According to another aspect, there is provided a beat timing generation method including generating, from data of music that has been input, information of timings on which a beat of the music depends and a plurality of pieces of intensity data indicating a power at the timings, calculating a period and a phase of the beat of the music using the plurality of pieces of intensity data, and detecting a beat generation timing on a basis of the period and the phase of the beat.

DESCRIPTION OF THE EMBODIMENTS

Hereinafter, with reference to the drawings, a beat timing generation device and a beat timing generation method according to the embodiment will be described. The configuration of the embodiment is an example. The present disclosure is not limited to the configuration of the embodiment.

Figure 1:
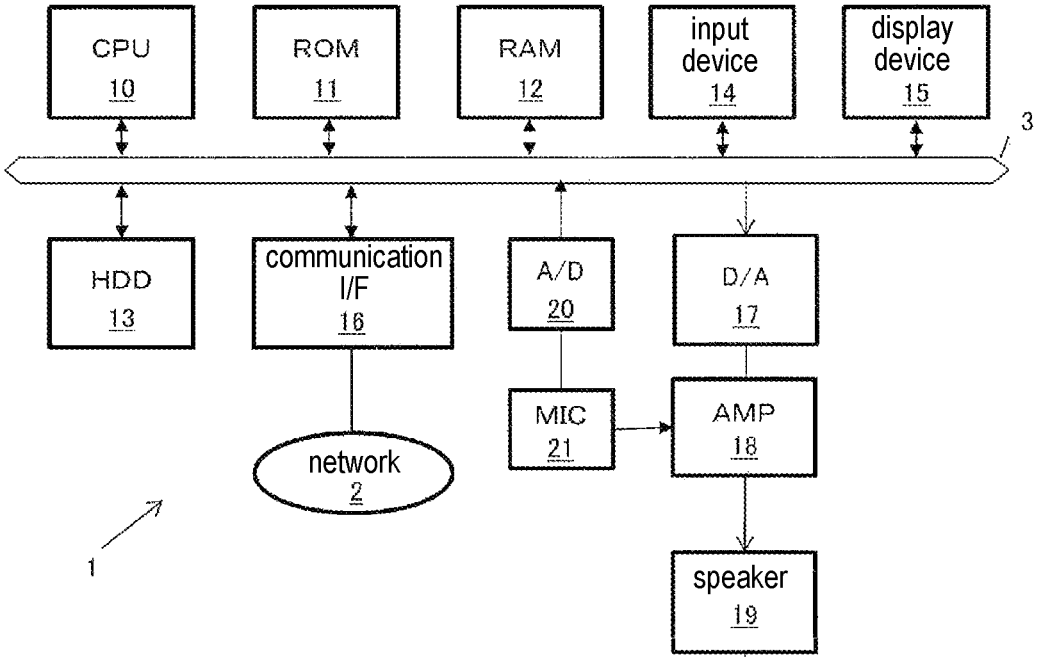
FIG. 1 shows an example of a configuration of a beat outputting timing generation device.

FIG. 1 shows an example of a configuration of a beat timing generation device. A beat timing generation device 1 includes a CPU 10, a read only memory (ROM) 11, a random access memory (RAM) 12, a hard disk drive (HDD) 13, an input device 14, a display device 15, and a communication interface (communication I/F) 16 which are connected to a bus 3. The beat timing generation device 1 further includes a digital/analog converter (D/A) 17 and an analog/digital converter (A/D) 20 which are connected to the bus 3. An amplifier (AMP) 18 is connected to the D/A 17, and a speaker 19 is connected to the AMP 18. A microphone (MIC) 21 is connected to the A/D 20.

The ROM 11 stores various programs executed by the CPU 10 and data used when the programs are executed. The RAM 12 is used as a development domain for the programs, an operation domain for the CPU 10, a storage domain for data, and the like. The HDD 13 stores the programs, the data used when the programs are executed, music data, and the like. For example, the music data is sound data having a predetermined audio file format such as an MP3 or a WAVE form. The format form of an audio file may be a form other than an MP3 or a WAVE form. The ROM 11 and the RAM 12 are examples of a main storage device, and the HDD 13 is an example of an auxiliary storage device. The main storage device and the auxiliary storage device are examples of a storage device or a storage medium.

The input device 14 includes keys, buttons, a touch panel, and the like and is used for inputting information (including an instruction and a command). The display device 15 is used for displaying information. The communication I/F 16 is connected to a network 2 and controls processing related to communication. The CPU 10 can download desired music data (musical signal) from the network 2, for example, in accordance with an instruction input from the input device 14 and can store the music data in the HDD 13.

The CPU 10 performs various kinds of processing by executing a program. In addition to the processing related to downloading of music, the processing includes processing related to reproduction of music, processing of generating a beat generation timing of music, processing of outputting a beat (for example, a clapping sound, particularly a hand clapping sound or the like) in accordance with a beat generation timing, and the like.

For example, when music data is reproduced, the CPU 10 generates digital data (digital signal) representing musical sound from music data read out from the HDD 13 to the RAM 12 by executing a program and supplies the digital data to the D/A 17. The D/A 17 converts digital data representing sound into an analog signal through digital/analog conversion and outputs the analog signal to the AMP 18. An analog signal of which an amplitude is adjusted by the AMP 18 is output from the speaker 19.

For example, the MIC 21 collects singing sound and the like accompanying musical sound (karaoke) output from the speaker 19. An analog audio signal collected by the MIC 21 has its amplitude amplified by the AMP 18 and is amplified through the speaker 19. At this time, singing sound may be mixed with musical sound or may be output from separate speakers individually.

In addition, the MIC 21 is also used when magnifying sound (outputting sound from the speaker 19) or recording sound by collecting audio of a performance using a musical instrument (a so-called live performance) or reproduced audio of music from external equipment. For example, a performance sound signal collected by the MIC 21 is converted into a digital signal by the A/D 20 and delivered to the CPU 10. The CPU 10 converts the performance sound signal into a form in accordance with an audio file format, generates an audio file, and stores the audio file in the HDD 13. The processing of generating a beat generation timing may be performed for a musical sound signal collected by the MIC 21.

The beat timing generation device 1 may include a drive device (not illustrated) for a disc-type recording medium such as a compact disc (CD). In this case, musical sound may be reproduced by supplying a digital signal representing musical sound read from a disc-type recording medium using the drive device to the D/A 17. In this case, processing of generating a beat generation timing may be performed for a musical sound signal read from the disc-type recording medium.

Figure 2:
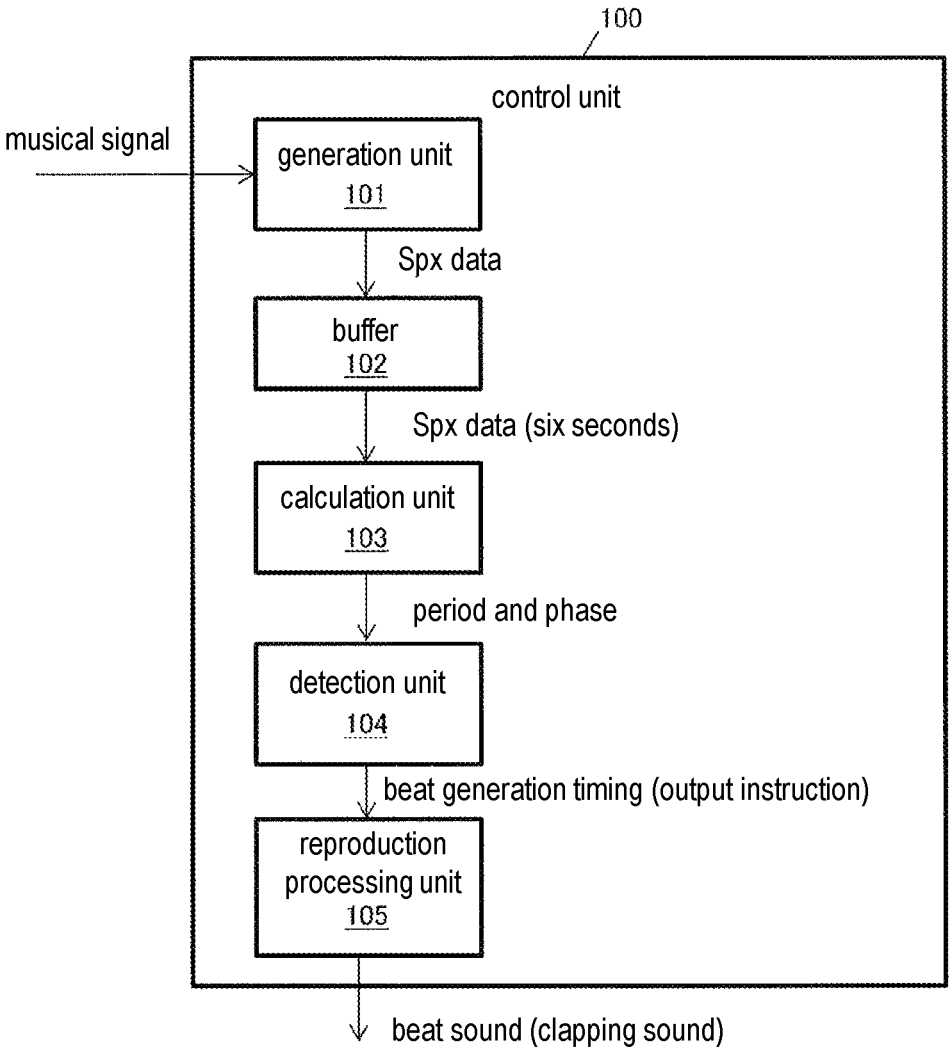
FIG. 2 shows an example of a configuration of a control unit.

FIG. 2 shows an example of a configuration of a control unit 100. Upon execution of a program, the CPU 10 operates as the control unit 100 including a generation unit 101 for time sparse data (marked as "Spx data": corresponding to intensity data), a buffer 102, a calculation unit 103 for period data and phase data, a detection unit 104 for a beat generation timing, and a reproduction processing unit 105 for a beat as shown in FIG. 2. For example, the buffer 102 is provided in a predetermined storage domain such as the RAM 12 or the HDD 13.

The generation unit 101 for Spx data generates and outputs Spx data using digital data representing musical sound. The buffer 102 accumulates the Spx data (corresponding to a plurality of pieces of intensity data) from over at least a predetermined time. In the present embodiment, a time period of six seconds is adopted for the predetermined time as an example, but the predetermined time may be longer or shorter than six seconds. The calculation unit 103 calculates period data and phase data of a beat using a cluster of the Spx data accumulated in the buffer 102 from over the predetermined time. The detection unit 104 for a generation timing detects a beat generation timing using period data and phase data. The reproduction processing unit 105 performs reproduction processing of a beat in accordance with a generation timing.

Hereinafter, processing of each part constituting the control unit 100 will be described in detail.

<Generation of Spx Data>

Generation of Spx data performed by the generation unit 101 will be described. A digital signal representing musical sound data (data sent to the D/A 17 for outputting audio) related to reproduction is input to the generation unit 101. A digital signal (musical signal) representing sound may be obtained through reproduction processing of music data stored in the HDD 13 or may be obtained through A/D conversion of an audio signal collected by the MIC 21.

Digital data representing sound is stored in the RAM 12 and is used for processing of the generation unit 101. Digital data representing sound is a cluster of sample (specimen) data (generally, voltage values of analog signals) gathered from analog signals in accordance with a predetermined sampling rate. In the present embodiment, as an example, the sampling rate is 44,100 Hz. However, the sampling rate can be suitably changed as long as a desired FFT resolution can be obtained.

Figure 3:
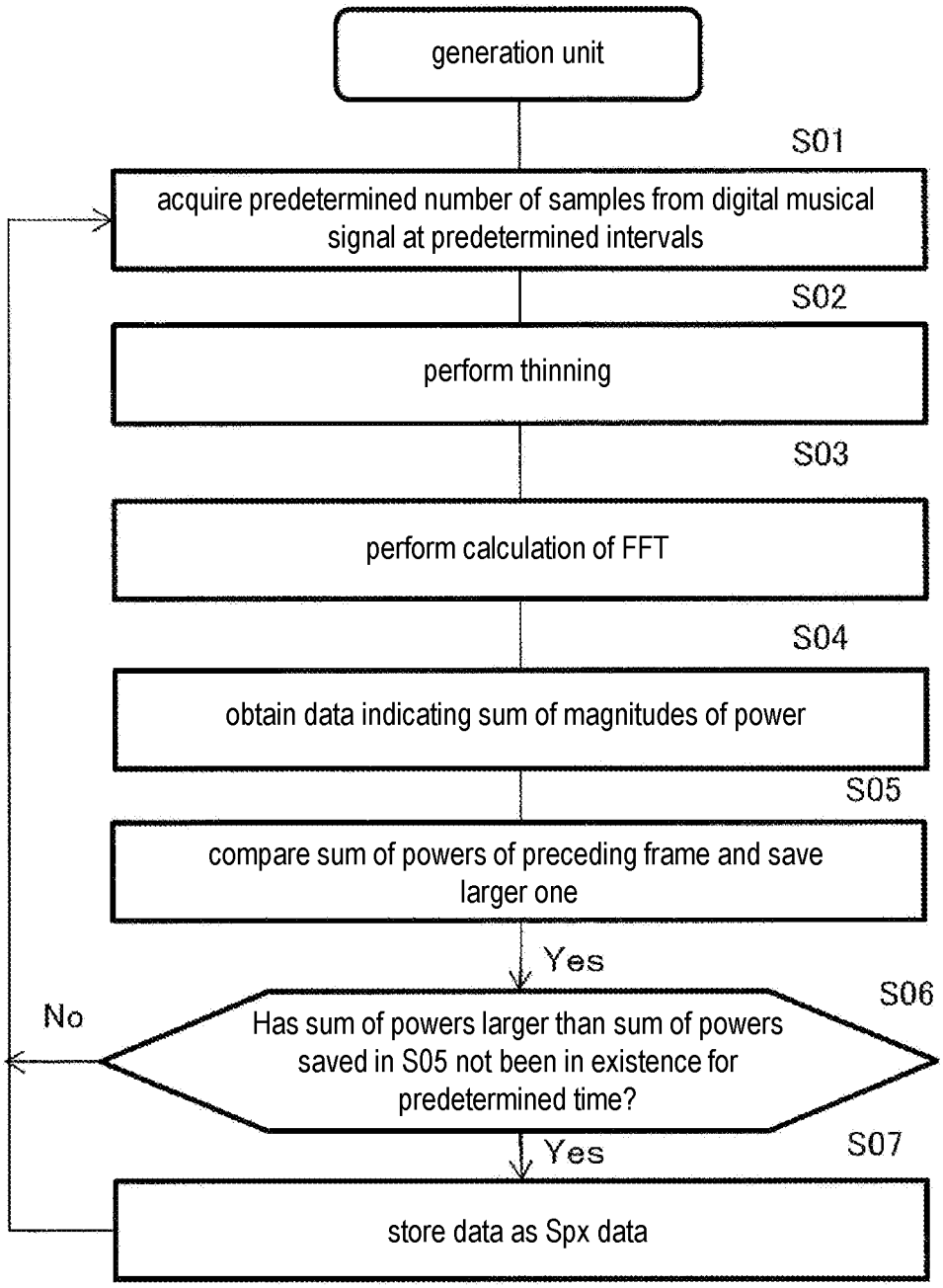
FIG. 3 is a flowchart showing an example of processing of a generation unit.

FIG. 3 is a flowchart showing an example of processing of the generation unit 101. Digital data (digital signal) which is sent to the D/A 17 in order to output (reproduce) music and represents musical sound is input to the generation unit 101. The generation unit 101 acquires a predetermined number of samples (which will be referred to as "a frame") from input digital data (S01). A predetermined number is 1,024 in the present embodiment, but it may be larger or smaller. The samples are acquired at predetermined intervals. For example, the predetermined intervals are 5 ms, but they may be longer or shorter.

In S02, the generation unit 101 performs thinning processing. That is, the generation unit 101 performs ¼ thinning with respect to 1,024 samples and obtains 256 samples. Thinning other than ¼ thinning may be adopted. In S03, the generation unit 101 performs fast Fourier conversion (FFT) with respect to 256 samples and obtains data (which will be referred to as power data) indicating a magnitude of power in units of frames from the results (power of each frequency bandwidth) of the FFT (S04). Since the power is expressed as a square of an amplitude, the concept of "power" also includes an amplitude.

For example, the power data is the sum of powers obtained by performing FFT with respect to 256 samples. When the power of a corresponding bandwidth in a preceding frame is subtracted from the power of each frequency bandwidth in a current frame and a value thereof is positive (power has increased), the value of the power is saved for calculation of the sum, but any other values than those described above (negative values after subtraction (power has decreased)) may be disregarded. This is because there is a high probability that a part having a large amount of increase in power is a beat.

In addition, as long as the comparison target is the same as that in another frame, a value used for calculating the sum may be the sum of powers of the current frame, may be the sum of powers of which the value obtained by subtracting the power of the preceding frame from the power of the current frame is a positive value, or may be a difference obtained by subtracting the power of the preceding frame from the power of the current frame. In addition, in a power spectrum obtained by performing FFT, calculation of the foregoing difference may be performed for only a frequency lower than a predetermined frequency. A frequency equal to or higher than the predetermined frequency may be filtered out using a low pass filter.

The power data is stored in the RAM 12 or the HDD 13 in units of frames. The generation unit 101 compares the magnitudes of the sums (peak values) of the power every time the power data in units of frames is prepared, saves data indicating a larger sum, and discards data indicating a smaller sum (S05). The generation unit 101 determines whether or not a sum larger than the sum saved in S05 has been in existence for a predetermined time (S06). The predetermined time is 100 ms, for example, but it may be longer or shorter than 100 ms. When a state in which data indicating a larger sum has not been in existence continues for the predetermined time, the generation unit 101 extracts the data indicating the sum of powers as Spx data and stores (retains) the Spx data in the buffer 102 (S07). In this manner, the Spx data is data obtained by extracting peak values of digital data indicating music at intervals of 100 ms and is data indicating information (information of timings) of timings on which a beat of music depends and the power at the timings. A plurality of pieces of Spx data is accumulated in the buffer 102. The generation unit 101 repeatedly performs the processing from S01 to S06.

Figure 4A:
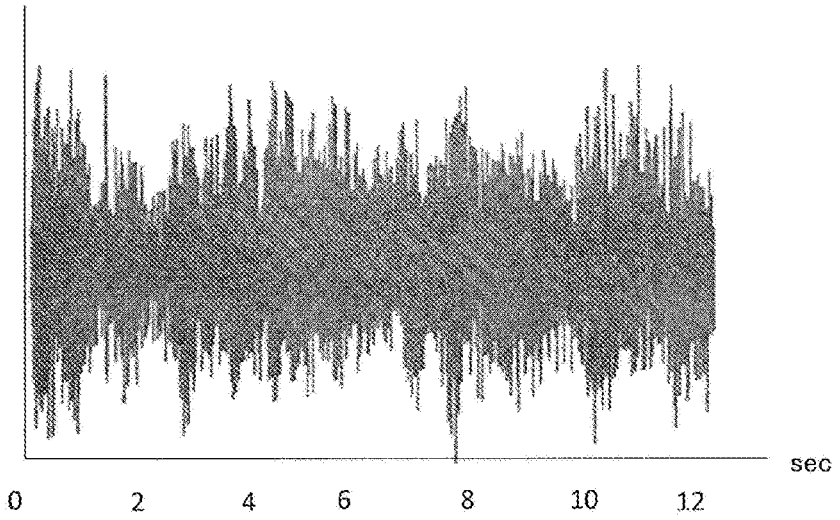
FIG. 4A shows an example of a digital musical signal (which will also be referred to as a musical signal) over 12 seconds input to the generation unit.
Figure 4B:
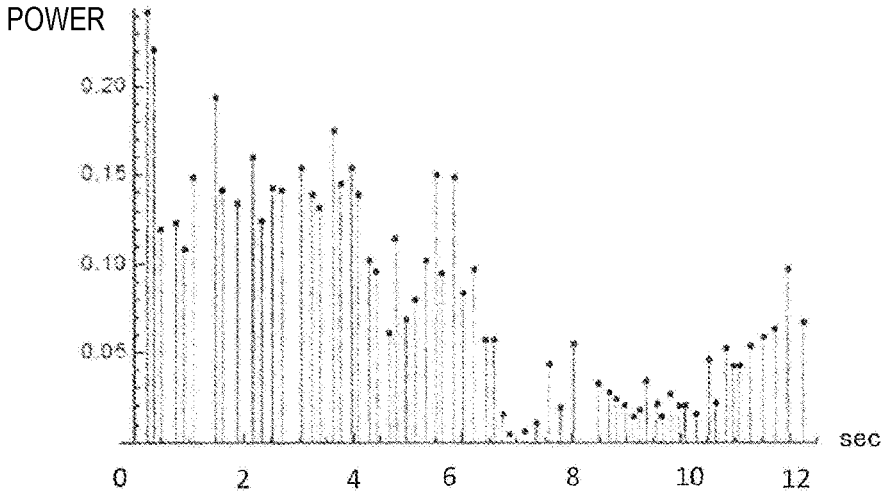
FIG. 4B shows an example of Spx data generated from the musical signal of FIG. 4A.

FIG. 4A shows a digital musical signal over 12 seconds input to the generation unit 101, and FIG. 4B shows an example of Spx data generated from the digital musical signal shown in FIG. 4A. The horizontal axis of the graph shown in FIG. 4B indicates time, and the vertical axis indicates the power. In this graph, vertical lines having a black dot at their upper end indicate individual pieces of Spx data obtained from the digital musical signal shown in FIG. 4A, the positions on the horizontal axis (time axis) indicate timings, and the lengths of the vertical lines indicate the power. Approximately ten pieces of Spx data are generated during one second when they are generated at intervals of 100 ms.

<Calculation of Period Data and Phase Data>

Figure 5:
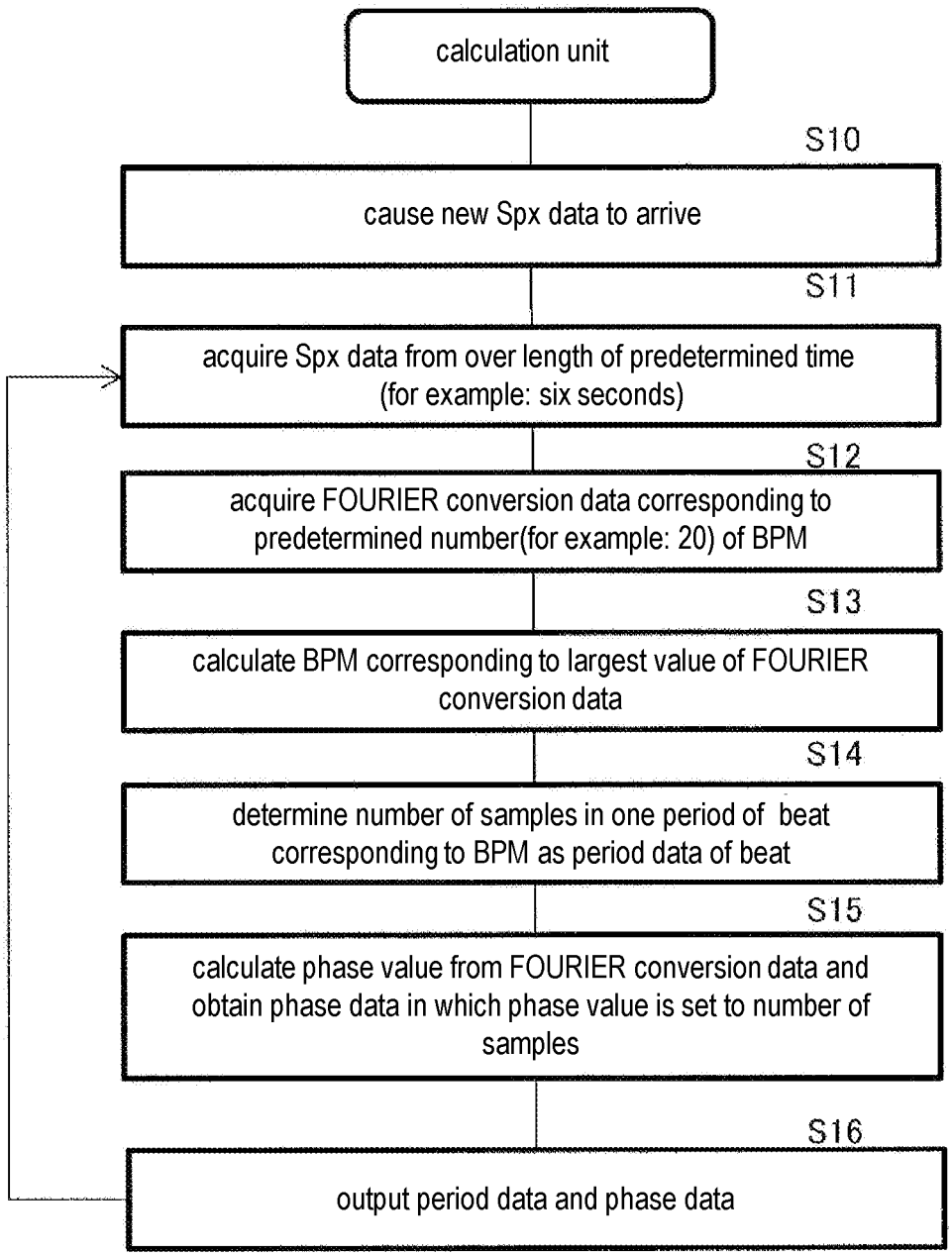
FIG. 5 is a flowchart showing an example of processing of a calculation unit.

FIG. 5 is a flowchart showing an example of processing of the calculation unit 103. In S10, new Spx data generated by the generation unit 101 arrives at the buffer 102 and is accumulated therein. In S11, the Spx data (corresponding to a plurality of pieces of intensity data), of the Spx data accumulated in the buffer 102, from over a predetermined time is acquired from the buffer 102. For example, the predetermined time is six seconds, but it may be longer or shorter than six seconds as long as the period and the phase of a beat can be obtained. The subsequent processing of S12 to S16 is processing performed using the six seconds of Spx data acquired in S11. In S12, Fourier conversion corresponding to a predetermined number (for example, 20) of beats per minute (BPM: indicating a tempo (rhythm speed)) values is performed for the six seconds of Spx data, and the period of the beat (one period with respect to the BPM) and the phase of the beat (beat generation timing) are calculated.

To be specific, the sum of products with respect to $\mathrm{Exp}(2\pi jft)$ (for a sine wave vibrating at a BPM frequency, the amplitude is the same regardless of the vibrational frequency) is obtained for a frequency (BPM frequency) $f=\{86, 90, 94, \text{and so on to } 168\}/60$ corresponding to a predetermined number of BPM values, for example, 20 BPM values within a range of 86 to 168 for the six seconds of Spx data. That is, Fourier conversion is performed. The result of Fourier conversion is adopted as Fourier conversion data c(i) (i=0, 1, 2, 3, and so on to 19).

Figure 6:
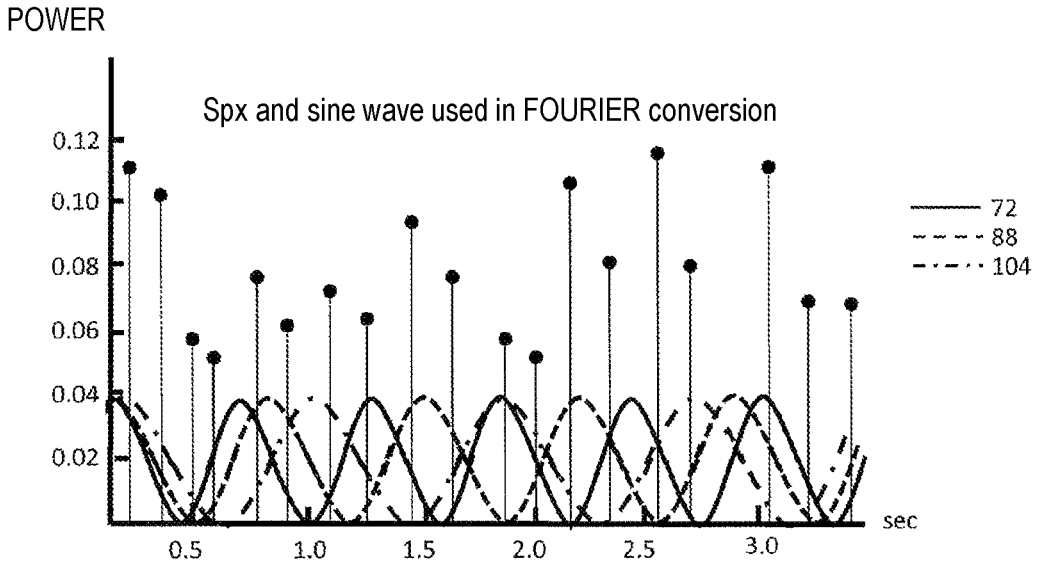
FIG. 6 is a view showing an example of Spx data and a BPM sine wave used in Fourier conversion.

FIG. 6 is a view showing an example of Spx data and a sine wave having a BPM frequency used for Fourier conversion. In the example of FIG. 6, a BPM sine wave of 72 (indicated by the solid line), a BPM sine wave of 88 (indicated by the dotted line), and a BPM sine wave of 104 (indicated by the one-dot dashed line) are shown as examples. The value of the Fourier conversion data c(i) is obtained by the following Expression 1. The values and the number of BPM values can be suitably changed.

[Math. 1]

$$c(i) = \sum_{k=1}^{M} x(t(k))\mathrm{Exp}(2\pi j f(i) t(k)) \tag{1}$$

Here, the factor t(k) in Expression 1 indicates a time position during the previous six seconds in which the Spx data is present and is based on units of seconds. The factor k indicates an index of the Spx data, such as k=1, and so on to M (M is the number of pieces of Spx data). In addition, the factor x(t(k)) indicates a current value (magnitude of the peak value) of the Spx data. The factor j indicates the unit of imaginary numbers ($j^2=-1$). The factor f(i) indicates a BPM frequency. For example, BPM 120 indicates 2.0 Hz.

The calculation unit 103 determines the BPM of which the absolute value corresponds to the largest value as the BPM of the Spx data (beat) in c(i)=(c0, c2, c3, and so on to c19) (S13). In addition, the phase value thereof (Phase) φ=Arg(c(i)) [rad] is adopted as a beat timing for the six seconds of Spx data. A beat timing indicates a relative position with respect to the beat generation timings which arrive periodically.

The phase value φ indicates a deflection angle of a complex number and can be obtained by the following Expression 2 when $c=c_{re}+jc_{im}$ ($c_{re}$ is a real part and $c_{im}$ is an imaginary part) is established.

[Math. 2]

$$\mathrm{Arg}(c(i)) = \begin{cases} \mathrm{ArcTan}\left(\frac{c_{im}}{c_{re}}\right) & c_{re} \geq 0,\ c_{im} \geq 0 \\ \mathrm{ArcTan}\left(\frac{c_{im}}{c_{re}}\right) + \pi & c_{re} < 0 \\ \mathrm{ArcTan}\left(\frac{c_{im}}{c_{re}}\right) + 2\pi & c_{re} \geq 0,\ c_{im} < 0 \end{cases} \tag{2}$$

Through calculation of the phase value φ, it is possible to ascertain the relative position of the beat generation timing with respect to a BPM sine wave, that is, the degree of a delay of the beat generation timing with respect to one period with respect to the BPM.

Figure 7:
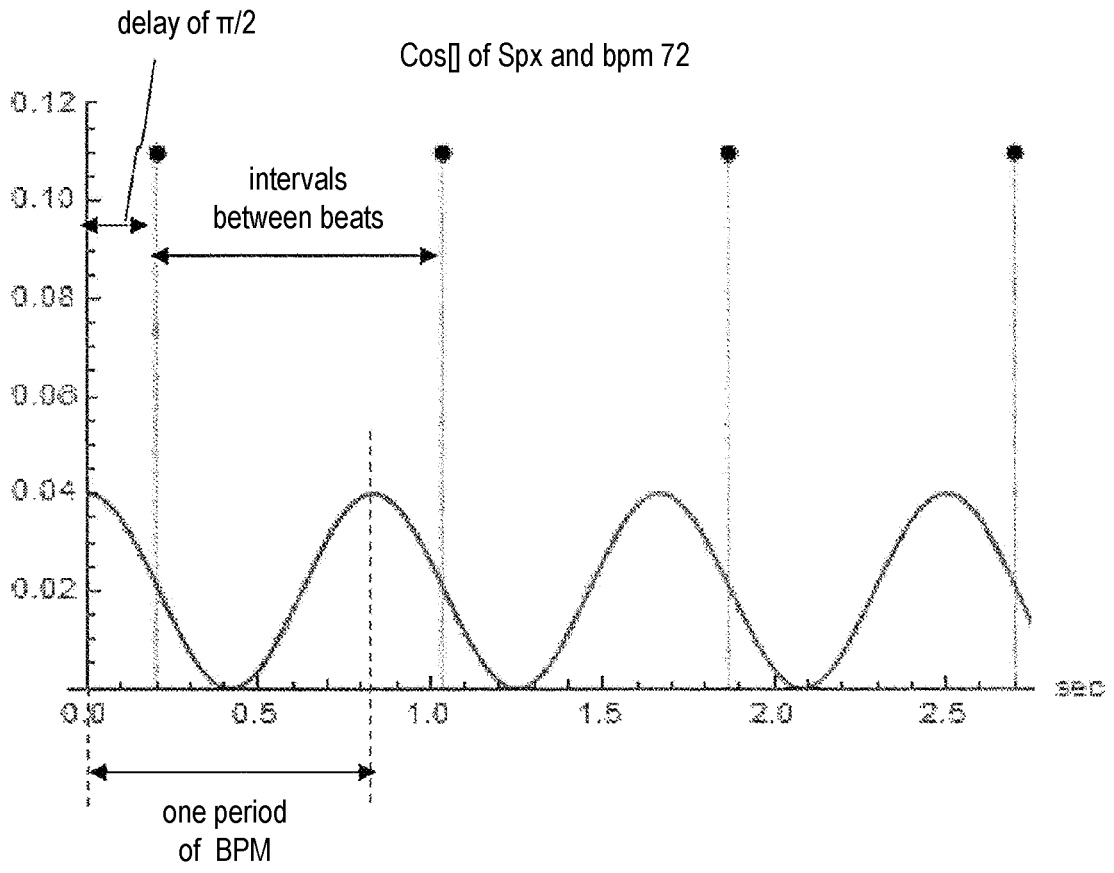
FIG. 7 illustrates a relationship between a cosine wave indicating a BPM and a beat generation timing.

FIG. 7 illustrates a relationship between a cosine wave (a real part of EXP(2πjft)) indicating a BPM and a beat generation timing. In the example of FIG. 7, there are four pieces of Spx data, and the BPM thereof is 72. Each piece of Spx data shown in FIG. 7 is a value (phase) of c(i) obtained using Expression 2 and indicates the beat generation timing. The gaps between the pieces of Spx data form the intervals between the beat generation timings. In the example of FIG. 7, the timing which is delayed by π/2 from a cosine wave having the BPM frequency and can be obtained through calculation of the phase value q becomes the beat generation timing. The calculation unit 103 takes the number of samples in one period with respect to the BPM as the period data (S14).

For example, when the BPM is 104 and the sampling rate is 44,100 Hz, the period data (the number of samples) has 44,100 [samples]/(104/60)=25,442 [samples]. In addition, in a case in which the period data has 25,442 [samples], when the phase value φ is 0.34 [rad], the phase data (the number of samples) has 25,442 [samples]×0.34 [rad]/2π[rad]=1,377 [samples] (S15). Further, the calculation unit 103 outputs the period data and the phase data (S16). The calculation unit 103 repeatedly performs the processing of S11 to S16 every time six seconds of Spx data has been accumulated. Accordingly, it is possible to follow a change in rhythm of music.

<Detection of Beat Generation Timing>

Figure 8:
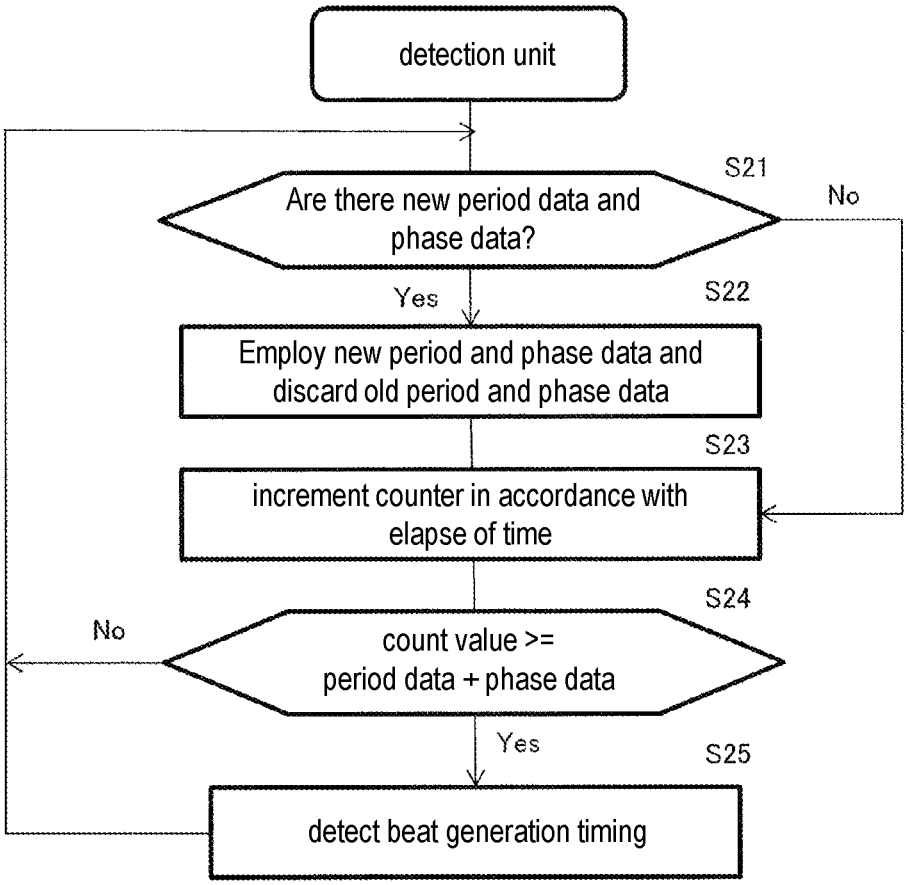
FIG. 8 is a flowchart showing an example of processing in which a detection unit 104 detects a beat generation timing.

FIG. 8 is a flowchart showing an example of processing in which the detection unit 104 detects a beat generation timing. In S21, the detection unit 104 determines whether new period data and phase data have been provided from the calculation unit 103. When new period data and phase data have been provided, the processing proceeds to S22. Otherwise, the processing proceeds to S23.

In S22, the detection unit 104 employs new period data and phase data for detecting the beat generation timing, and old period data and old phase data are discarded. At this time, when Spx data is prepared, the samples of the frame constituting the Spx data are in a state in which a delay of 100 ms is applied thereto. Therefore, here, time adjustment (phase adjustment) is performed such that music and the rhythm being performed or reproduced and a hand clapping sound (which will be described below) coincide with each other. Thereafter, the processing proceeds to S23.

In S23, a counter is set using the number of samples of the period data and the number of samples of the phase data. For example, the detection unit 104 has a counter counting up (incrementing) for each one of the samples (intervals between voltage checks of the analog signal in accordance with the sampling rate) according to the sampling rate and incrementing up to the count value of the counter for each one of the samples. Accordingly, the detection unit 104 stands by until the count value becomes equal to or larger than a predetermined value (a value indicating the sum of the number of samples (count value) of the phase data and the number of samples (count value) of the period data) from zero (S24).

When the count value of the counter becomes equal to or larger than the predetermined value, the detection unit 104 detects the beat generation timing based on the estimation and outputs an output instruction of a beat (S25). In response to the output instruction, the reproduction processing unit 105 sends the digital data of the beat (for example, a hand clapping sound) which has been stored in the ROM 11 or the HDD 13 in advance to the D/A 17. The digital data is converted into an analog signal by the D/A 17, has its amplitude amplified by the AMP 18, and then is output from the speaker 19. Accordingly, a hand clapping sound is output in a manner of being superimposed on the music being reproduced or performed.

Effects of Embodiment

According to the embodiment, music which has been reproduced or performed (in the past) is input to the generation unit 101, and the generation unit 101 generates Spx data. Such Spx data is accumulated in the buffer 102, the calculation unit 103 calculates the period and the phase of a beat from a plurality of pieces of Spx data from over a predetermined time (six seconds), and the detection unit 104 detects and outputs the beat generation timing in accordance with the music being reproduced or performed. Accordingly, the reproduction processing unit 105 can output a hand clapping sound which coincides with the rhythm of music being reproduced or performed. This hand clapping sound can be automatically output through generation of the Spx data described above, calculation of the period and the phase of the beat based on the Fourier conversion data, and a simple algorithm having a small amount of calculation, such as counting up to the counter value. Accordingly, increase in load with respect to an object (CPU 10) which executes processing or increase in memory resource usage can be avoided. In addition, due to the small amount of processing, a clapping sound can be output without a delay (or even if there is a delay, people cannot recognize the delay) with respect to reproduction sound or performance sound.

The processing performed by the control unit 100 may be performed using a plurality of CPUs (processors) or may be performed using a CPU having a multi-core configuration. In addition, the processing performed by the control unit 100 may be executed by a processor (a DSP, a GPU, or the like) other than the CPU 10, an integrated circuit (an ASIC, an FPGA, or the like) other than a processor, or a combination (an MPU, an SoC, or the like) of a processor and an integrated circuit.

Modification Example

Figure 9:
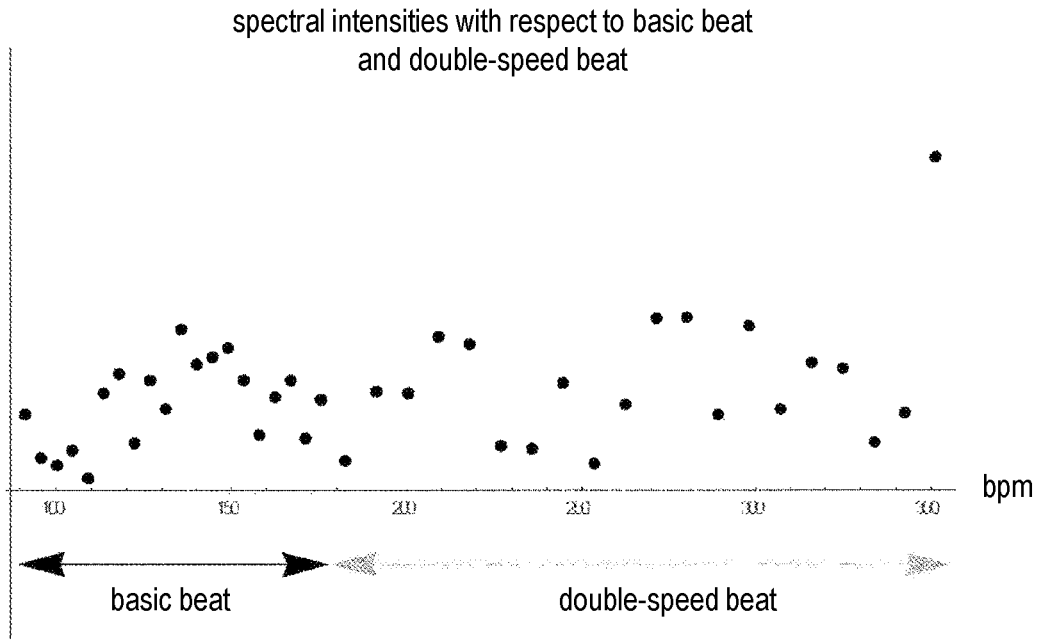
FIG. 9 is a view showing an example of spectral intensities of a single-speed beat (basic beat) and a double-speed beat.

In the embodiment described above, regarding the BPM used for calculating a period data, an example using a BPM within a range of 86 to 168 has been described. In contrast, the absolute value (spectral intensity) of c(i) is obtained in not only the BPM within a range of 86 to 168 (each thereof corresponds to a first BPM) but also in the BPM within a range of 172 to 336 (twice thereof) or the BPM within a range of 344 to 672 (four times thereof) (corresponding to at least one second BPM having the vibrational frequency which is an integral multiple of the vibrational frequency of the first BPM). FIG. 9 is a view showing an example of spectral intensities of a single-speed beat (basic beat) and a double-speed beat. An example of spectrums of a single speed and a double speed is shown. Further, values obtained by adding the spectral intensities related to each of the beats at a single speed, a double speed, and a quadruple speed at a predetermined ratio is used for determining the BPM. For example, the spectral intensity of BPM 91 (an example of the first BPM), the spectral intensities of BPM 182 and BPM 364 (an example of at least one second BPM) are added at the ratio of 0.34:0.33:0.33, and the numerical value is used as the absolute value of c(i) for the BPM 91.

Depending on the music, since there may be a greater power with respect to a BPM corresponding to finer eighth notes or sixteenth notes than a basic beat symbolized by quarter notes, a better BPM may be able to be selected by reflecting twice or four times this power in the intensity of the basic beat. In the foregoing example, twice or four times are adopted as an example of an integral multiple, but similar effects can be obtained with an integral multiple of three times, five times, or greater. The constituents shown in the embodiment can be suitably combined within a range not departing from the objective.

What is claimed is:

1. A beat timing generation device comprising:

a processor, configured to:

generate, from data of music that has been input, information of a plurality of timings on which a beat of the music depends and a plurality of pieces of intensity data indicating a power at each of the plurality of timings;

calculate a period and a phase of the beat of the music by using the plurality of pieces of intensity data, wherein a beats per minute (BPM) for the plurality of pieces of intensity data is set on a basis of the timings indicated by the plurality of pieces of intensity data, one period of the BPM is calculated as the period of the beat, and a relative position of a beat generation timing is calculated with respect to a periodic wave indicating the BPM as the phase of the beat; and detect the beat generation timing on a basis of the period and the phase of the beat.

2. The beat timing generation device according to claim 1, wherein the processor is further configured to:

perform reproduction processing of the beat in accordance with the beat generation timing.

3. The beat timing generation device according to claim 2, wherein the periodic wave is a sine wave, and wherein the processor obtains a count value indicating a number of samples of the period of the beat and a number of samples of the phase of the beat acquired at each predetermined interval in accordance with a sampling rate, performs counting up to the count value using a counter incremented for the sampling rate for each one of the samples, and detects a timing as the beat generation timing when a value of the counter reaches the count value.

4. The beat timing generation device according to claim 3, wherein the processor acquires a plurality of pieces of intensity data for a predetermined time, performs Fourier conversion on each of the plurality of pieces of intensity data to acquire Fourier conversion data corresponding to a plurality of BPMs, and determines a largest value among values of the plurality of BPMs as the BPM of the plurality of pieces of intensity data.

5. The beat timing generation device according to claim 4, wherein the processor acquires a first BPM having the largest value among the values of the plurality of BPMs and a second BPM, among the plurality of BPMs, having a vibrational frequency which is an integral multiple of a vibrational frequency of the first BPM, and the processor calculates a weighted sum of a value of the first BPM and a value of the second BPM as a new BPM for the first BPM.

6. The beat timing generation device according to claim 2, wherein the processor acquires a frame consisting of a predetermined number of continuous samples of sound from data of the music that has been input, performs thinning of the samples in the frame, performs fast Fourier conversion for the thinned samples, performs processing of obtaining data indicating a sum of powers of each frequency bandwidth obtained through fast Fourier conversion at predetermined intervals, and extracts data indicating the sum of the powers as the intensity data when the data indicating the sum of the powers being a maximum value.

7. The beat timing generation device according to claim 1, wherein the periodic wave is a sine wave, and wherein the processor obtains a count value indicating a number of samples of the period of the beat and a number of samples of the phase of the beat acquired at each predetermined interval in accordance with a sampling rate, performs counting up to the count value using a counter incremented for the sampling rate for each one of the samples, and detects a timing as the beat generation timing when a value of the counter reaches the count value.

8. The beat timing generation device according to claim 7, wherein the processor acquires a plurality of pieces of intensity data for a predetermined time, performs Fourier conversion on each of the plurality of pieces of intensity data to acquire Fourier conversion data corresponding to a plurality of BPMs, and determines a largest value among values of the plurality of BPMs as the BPM of the plurality of pieces of intensity data.

9. The beat timing generation device according to claim 8, wherein the processor acquires a first BPM having the largest value among the values of the plurality of BPMs and a second BPM, among the plurality of BPMs, having a vibrational frequency which is an integral multiple of a vibrational frequency of the first BPM, and the processor calculates a weighted sum of a value of the first BPM and a value of the second BPM as a new BPM for the first BPM.

10. The beat timing generation device according to claim 8, wherein the processor acquires a frame consisting of a predetermined number of continuous samples of sound from data of the music that has been input, perform is thinning of the samples in the frame, performs fast Fourier conversion for the thinned samples, performs processing of obtaining data indicating a sum of powers of each frequency bandwidth obtained through fast Fourier conversion at predetermined intervals, and extracts data indicating the sum of the powers as the intensity data when the data indicating the sum of the powers being a maximum value.

11. The beat timing generation device according to claim 7, wherein the processor acquires a frame consisting of a predetermined number of continuous samples of sound from data of the music that has been input, performs thinning of the samples in the frame, performs fast Fourier conversion for the thinned samples, performs processing of obtaining data indicating a sum of powers of each frequency bandwidth obtained through fast Fourier conversion at predetermined intervals, and extracts data indicating the sum of the powers as the intensity data when the data indicating the sum of the powers being a maximum value.

12. The beat timing generation device according to claim 1, wherein the processor acquires a frame consisting of a predetermined number of continuous samples of sound from data of the music that has been input, performs thinning of the samples in the frame, performs fast Fourier conversion for the thinned samples, performs processing of obtaining data indicating a sum of powers of each frequency bandwidth obtained through fast Fourier conversion at predetermined intervals, and extracts data indicating the sum of the powers as the intensity data when the data indicating the sum of the powers being a maximum value.

13. The beat timing generation device according to claim 1, wherein the processor is further configured to:

output a first sound signal superimposed on the music according to the beat generation timing.

14. A beat timing generation method comprising:

a generation step generating, from data of music that has been input, information of a plurality of timings on which a beat of the music depends and a plurality of pieces of intensity data indicating a power at each of the plurality of timings;

a calculation step calculating a period and a phase of the beat of the music by using the plurality of pieces of intensity data, wherein a beats per minute (BPM) for the plurality of pieces of intensity data is set on a basis of the timings indicated by the plurality of pieces of intensity data, one period of the BPM is calculated as the period of the beat, and a relative position of a beat generation timing is calculated with respect to a periodic wave indicating the BPM as the phase of the beat; and a detection step detecting the beat generation timing on a basis of the period and the phase of the beat.

15. The beat timing generation method according to claim 14 further comprising:

a reproduction processing step performing reproduction processing of the beat in accordance with the beat generation timing.

16. The beat timing generation method according to claim 14, wherein the periodic wave is a sine wave, and wherein the detection step obtains a count value indicating a number of samples of the period of the beat and a number of samples of the phase of the beat acquired at each predetermined interval in accordance with a sampling rate, performs counting up to the count value using a counter incremented for the sampling rate for each one of the samples, and detects a timing as the beat generation timing when a value of the counter reaches the count value.

17. The beat timing generation method according to claim 16, wherein the calculation step acquires a plurality of pieces of intensity data for a predetermined time, performs Fourier conversion on each of the plurality of pieces of intensity data to acquire Fourier conversion data corresponding to a plurality of BPMs, and determines a largest value among values of the plurality of BPMs as the BPM of the plurality of pieces of intensity data.

18. The beat timing generation method according to claim 17, wherein the calculation step acquires a first BPM having the largest value among the values of the plurality of BPMs and a second BPM, among the plurality of BPMs, having a vibrational frequency which is an integral multiple of a vibrational frequency of the first BPM, and the calculation step calculates a weighted sum of a value of the first BPM and a value of the second BPM as a new BPM for the first BPM.

19. The beat timing generation method according to claim 14, wherein the generation step acquires a frame consisting of a predetermined number of continuous samples of sound from data of the music that has been input, performs thinning of the samples in the frame, performs fast Fourier conversion for the thinned samples, performs processing of obtaining data indicating a sum of powers of each frequency bandwidth obtained through fast Fourier conversion at predetermined intervals, and extracts data indicating the sum of the powers as the intensity data when the data being a maximum value.

20. A beat timing generation device comprising:

a processor, configured to:

generate, from data of music that has been input, information of a plurality of timings on which a beat of the music depends and a plurality of pieces of intensity data indicating a power at each of the plurality of timings, wherein each of the plurality of pieces of intensity data corresponds to data indicating the sum of the powers as the intensity data when the data indicating the sum of the powers being a maximum value;

calculate a period and a phase of the beat of the music by using the plurality of pieces of intensity data; and detect a beat generation timing on a basis of the period and the phase of the beat.

* * * * *